US007874034B1

(12) United States Patent
Mack et al.

(10) Patent No.: US 7,874,034 B1
(45) Date of Patent: Jan. 25, 2011

(54) BOWRING FIREFIGHTER TOOL

(76) Inventors: Tony Lane Mack, 2900 Long Dr., Newcastle, OK (US) 73065; Samuel Clint Bowring, 1054 Live Oak La., Blanchard, OK (US) 73010

( * ) Notice: Subject to any disclaimer, the term of this patent is extended or adjusted under 35 U.S.C. 154(b) by 153 days.

(21) Appl. No.: 12/384,350

(22) Filed: Apr. 4, 2009

Related U.S. Application Data

(60) Provisional application No. 61/141,158, filed on Dec. 29, 2008.

(51) Int. Cl.
*B25F 1/00* (2006.01)
*B25B 13/48* (2006.01)

(52) U.S. Cl. ..... 7/138; 7/169; 81/176.1

(58) Field of Classification Search ..... 7/138, 7/169, 170; 81/125.1, 176.1, 176.2; D6/320, D6/323; D8/16, 17, 19, 27, 71, 105, 371, D8/372; D29/124
See application file for complete search history.

(56) References Cited

U.S. PATENT DOCUMENTS

| | | | | | |
|---|---|---|---|---|---|
| 241,893 | A | * | 5/1881 | Thayer | 7/169 |
| 730,119 | A | | 6/1903 | Hanson | |
| D54,394 | S | | 2/1920 | Dodge | |
| 1,400,285 | A | | 12/1921 | Hart | |
| 1,465,009 | A | | 8/1923 | Wasseth | |
| 1,527,772 | A | * | 2/1925 | Baird | 81/176.1 |
| 1,703,856 | A | | 2/1929 | McKeag | |
| 1,763,353 | A | | 6/1930 | Heller | |
| 1,784,535 | A | | 12/1930 | Osterby | |
| 2,360,163 | A | * | 10/1944 | Sadler | 81/176.1 |
| D142,263 | S | * | 8/1945 | Pierre | D8/26 |
| D210,141 | S | | 2/1968 | Woods | |
| 3,692,269 | A | * | 9/1972 | Hales | 248/691 |
| 3,949,439 | A | | 4/1976 | Ardis | |
| D244,252 | S | | 5/1977 | Ardis | |
| D262,183 | S | | 12/1981 | Brown | |
| D263,674 | S | | 4/1982 | Ebert | |
| D275,258 | S | | 8/1984 | Albrecht | |
| 4,597,123 | A | | 7/1986 | Cobe | |
| 4,646,378 | A | | 3/1987 | Borden | |
| 5,247,715 | A | | 9/1993 | Nishiguchi | |
| 5,428,853 | A | | 7/1995 | Menke | |
| 6,298,754 | B1 | | 10/2001 | Brown | |
| 6,308,355 | B1 | * | 10/2001 | McMillan et al. | 7/142 |
| 6,447,033 | B1 | | 9/2002 | Konczak | |
| 6,899,001 | B1 | | 5/2005 | Sanders | |
| D553,482 | S | * | 10/2007 | Magalhaes et al. | D8/371 |
| D566,494 | S | | 4/2008 | Karl | |
| D596,011 | S | * | 7/2009 | Almayda | D8/105 |
| 2008/0216619 | A1 | | 9/2008 | Brackbill | |

* cited by examiner

*Primary Examiner*—David B Thomas
(74) *Attorney, Agent, or Firm*—Randal D. Homburg

(57) ABSTRACT

A multiple use tool providing a variety of different features for use by firefighters as a hose coupling wrenches, pin and lug wrenches, valve wrenches, hose carrying and anchoring hooks, a glass cutting tool, a rope rapelling and belay apparatus and several other common firefighter tools all provided in a single tool, compact and conveniently provided in a single device.

6 Claims, 7 Drawing Sheets

BOWRING FIREFIGHTER TOOL

CROSS REFERENCE TO RELATED APPLICATIONS

Applicant claims the benefit of provisional patent Application No. 61/141,158 filed on Dec. 29, 2008, by the same inventors.

BACKGROUND OF THE INVENTION

1. Field of Invention

A multiple use tool providing a variety of different features for use by firefighters as a hose coupling wrenches, pin and lug wrenches, valve wrenches, hose carrying and anchoring hooks, a glass cutting tool, a rope rapelling and belay apparatus and several other common firefighter tools all provided in a single tool, compact and conveniently provided in a single device.

2. Description of Prior Art

A preliminary review of prior art patents was conducted by the applicant which reveal prior art patents in a similar field or having similar use. However, the prior art inventions do not disclose the same or similar elements as the present multiple use firefighter tool, nor do they present the material components in a manner contemplated or anticipated in the prior art.

The prior art relevant to the present multiple use firefighter's too appears to fall into three categories—multiple component multi-tools, single piece multi-tools, and hose carrying devices.

The multiple component multi-tools provide several features for use in firefighting or other activities. In design U.S. Pat. No. D566,494 to Karl, an emergency tool provides an adjustable hydrant valve wrench, a water cutoff wrench, a pry hook or cutting tool and a possible hatchet end. In U.S. Pat. No. 6,899,001 to Sanders, an adjustable length ratchet wrench, hydrant wrench and hose connector wrench is disclosed which also defines a water valve or gas valve opening, this device having several components comprising its assembly. Pivotally acting spanner wrenches are disclosed in U.S. Pat. Nos. 5,247,715 to Nishiguchi, D244,252 to Ardis and 1,784,535 to Osterby. A pivotal hydrant wrench and spanner/lug wrench is disclosed in U.S. Pat. No. 1,763,353 to Heller. In U.S. Pat. No. 1,465,009 to Wasseth provides a pipe wrench having an adjustable jaw, several formed slots to fit several different size and shaped valves, and a hammer.

Of the single piece tools, to which the present invention would be categorically similar, a demolition tool is shown in U.S. Pat. No. 4,597,123 to Cobe, Jr., having a claw, a hammer and a pry bar. An emergency entrance tool is shown in U.S. Pat. No. D275,258 to Albrecht. A couple of spanner wrenches are shown in U.S. Pat. Nos. D263,674 to Ebert (a spanner and hydrant wrench) and 1,400,285 to Hart (a spanner wrench). A multi-tool having a pick, a spanner wrench, a hydrant valve wrench and a handle is shown in U.S. Pat. No. D54,394 to Dodge. A detachable hand tool attaches to a fire hose and provides multiple valve openings, a hydrant wrench and forms on an end a hook, which may be used to secure the attached hose to an object, indicated in U.S. Pat. No. 1,703,856 to McKeag. A hook and pry tool is shown in U.S. Pat. No. D210,141 to Woods. The hose carrying tools are shown in U.S. Pat. Nos. D262,183 to Brown and 730,119 to Hanson.

SUMMARY OF THE INVENTION

Firefighter's use a variety of tools when performing their jobs. These tools typically involve tools for connecting and disconnecting hoses of small and large sizes, breaking into structures and removing dangerous structural components in a building, turning valves, pins and lugs on gas meters, bottles of compressed gas, and water lines, use of hooks and clamps to anchor or support fire hoses during use, wedges, turning pins and lugs of hoses and hydrants and their connections, and tools used by mountaineers for climbing and descending ropes, cables and ladders. For this profession, firefighters have a variety of tools they use, and often use several tools to accomplish each required task, requiring a heavy tool box containing a selection of the several tools for the multiple tasks they may face.

Several multiple use tools have been disclosed in prior art. A few disclose and device made from a single piece of metal or high heat plastic and several have more than one integrated component forming the complete tool. These tools either have limited use and function or they require the assembly of components to form the tools. The present firefighter tool provides a multiple use tool which would replace numerous tools, be easily carried by every firefighter at a fire scene and would be easier to keep track of during use while easily replaced if lost or damaged.

The primary objective of the invention is to provide a multiple use firefighter tool to serve the place of multiple tools for common firefighting needs while performing their duties. It also provides the same tool for safety purposes, to serve as a wrench for multiple valves, pins, lugs and hose connections, and also to serve other disclosed functions.

DESCRIPTION OF THE DRAWINGS

The following drawings are submitted with this utility patent application.

FIG. 6 is a representation of the device used as a belay anchor for a rope descent.

DESCRIPTION OF THE PREFERRED EMBODIMENT

Figure 1:
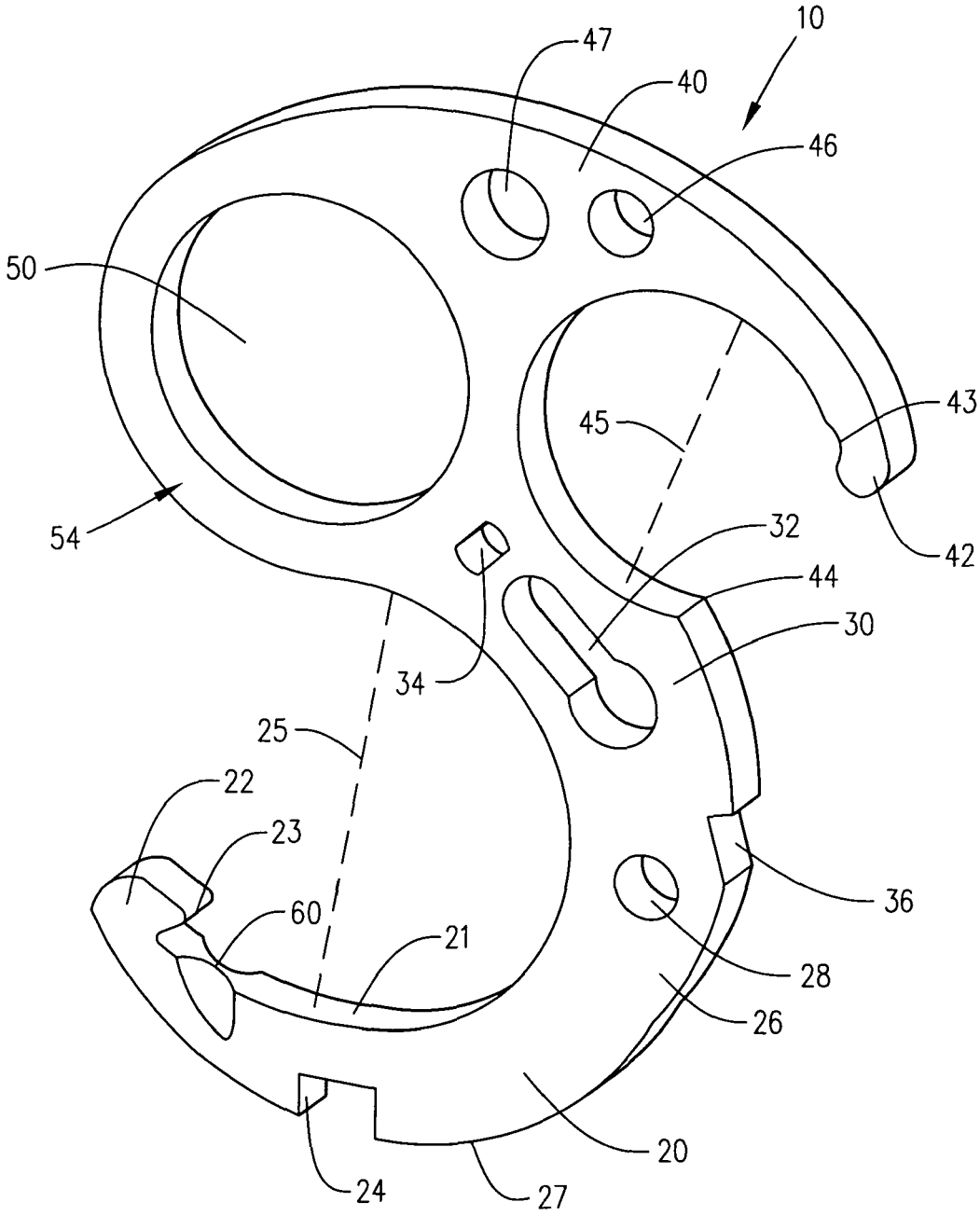
FIG. 1 is a perspective view of the firefighter tool.

A compact S-shaped multiple use tool 10 for use by firefighters made from a shingle sheet or a single cast of a strong, non-deformable material, indicated in FIGS. 1-7 of the drawings, defining a lower loop 20 providing an inner tip 22 with a drag hook 23, a large water or gas valve notch 24, an inner diameter 25 to hook and retain a large fire hose, and a side portion 26 defining at least one, small pin or lug spanner bore 28, a central transition portion 30 defining a gas valve slot 32, an oxygen bottle valve opening 34, and a STORZ notch 36, and an upper loop 40 defining an inner tip 42 with a spanner indent 43 and an inner loop shoulder 44, a closed circular handle portion 50, at least one small pin lug opening 46 and a large pin lug opening 47, and having an inner diameter 45 to hook and retain a small fire hose, the tool 10 used as a hose connector wrench, a large and small hose carrier and hanger, a rappel anchor, a hose connector wrench, a spanner wrench, a valve wrench, and pry device, a hook anchor device or a tool hanger.

More specifically, the tool 10 may include at least one or all of the following defined elements. The large pin lug opening 47 located in the upper loop 40 may be used to connect the tool 10 to a belt by use of a carabiner or connecting hook, not shown, and also to attach to a large pin lug when the tool 10 is used as a pin lug wrench, FIG. 4. The closed circular handle portion 50, the upper loop 40 and the gas valve slot 32 may be used in conjunction with a threaded rope, shown in FIG. 6, for a rope descent, as a rappel anchor. The gas valve slot 32 may also be used to turn a gas valve on a gas meter, FIG. 3. A standard oxygen bottle valve may be turned with the oxygen bottle valve opening 34 located within the central transition portion 30. The upper loop 40 provides the inner diameter 45 to accept and retain a 1-1¾ inch fire hose when under pressure with the tool 10 used for the advancement, stabilization and assistance in control of the nozzle and for leverage against the nozzle back pressure, FIG. 7. The opening of the upper loop 40 between the spanner indent 43 and the STORZ notch 36 provides the tool 10 as a spanner wrench for sizes 1½ to 2½ inch lug couplings and STORZ couplings, FIG. 5. The lower loop 20 may serve as a rescue drag hook or a hose anchor, the lower loop 20 providing the inner diameter 25 to receive a large fire hose from 2-3 inches, the lower loop 20 also serving as a spanner wrench for sizes 2½ inch and larger couplings and larger STORZ couplings. This lower loop 20 may also provide a tapered cutting notch 60, FIGS. 1-2, on an inner margin 21 of the lower loop 20 adjacent to the drag hook 23 for use to rip glass and screen material in an automobile, structure or building to gain entry. On an outer edge 27 of the lower loop 20, the large water and gas valve notch 24 is provided to engage a common water valve on a water meter, or it may also be used to snap a piece of glass or sheet material when attached to an edge of the material and pulled out, applying leveraged force along the edge of the material to break the material. One or more of the at least one small pin lug openings 46 and lug spanner bores 28 may be provided within the upper loop 40 or within the lower loop 20 to engage a 1½ inch pin lug.

Figure 2:
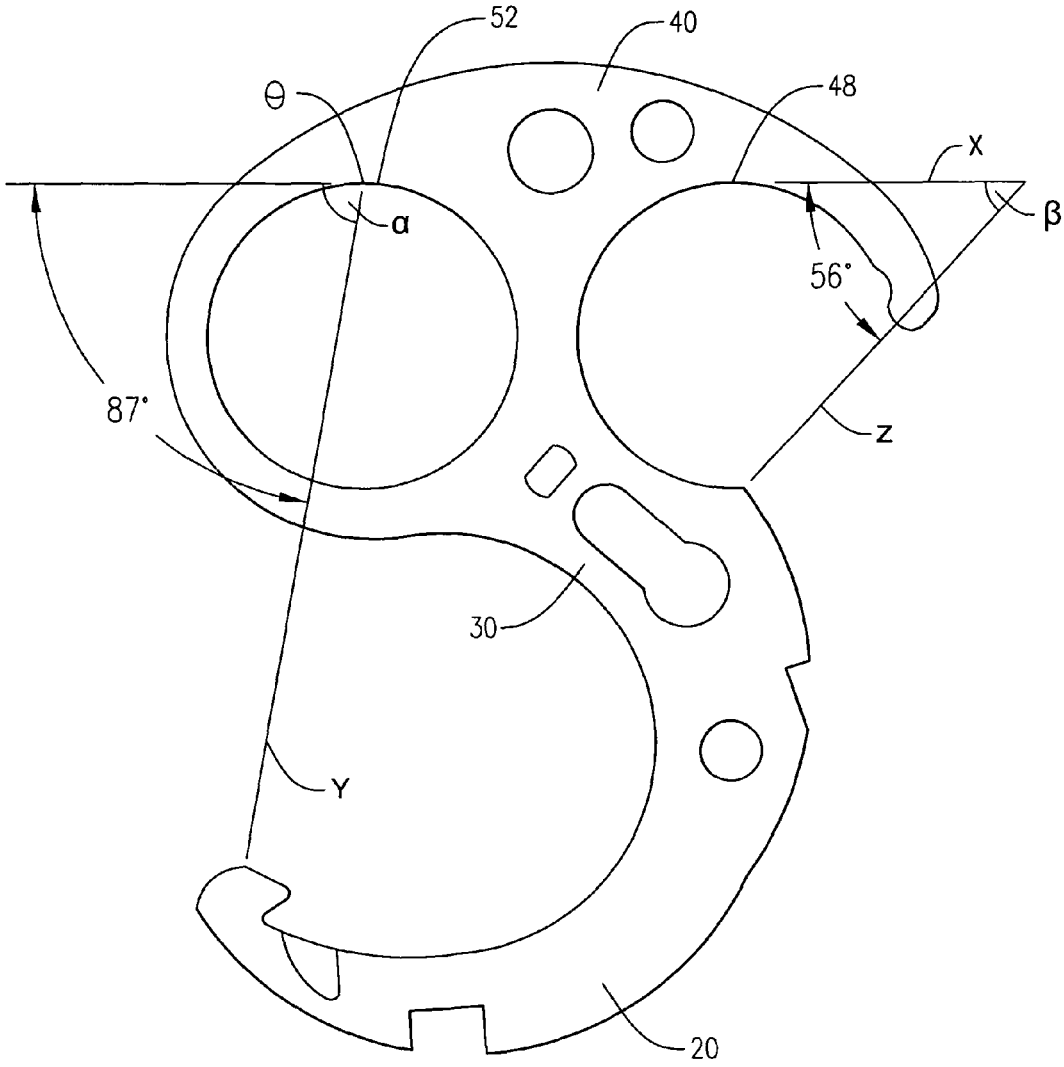
FIG. 2 is a front view of the tool indicating the relative angles of certain reference points within the device.
Figure 3:
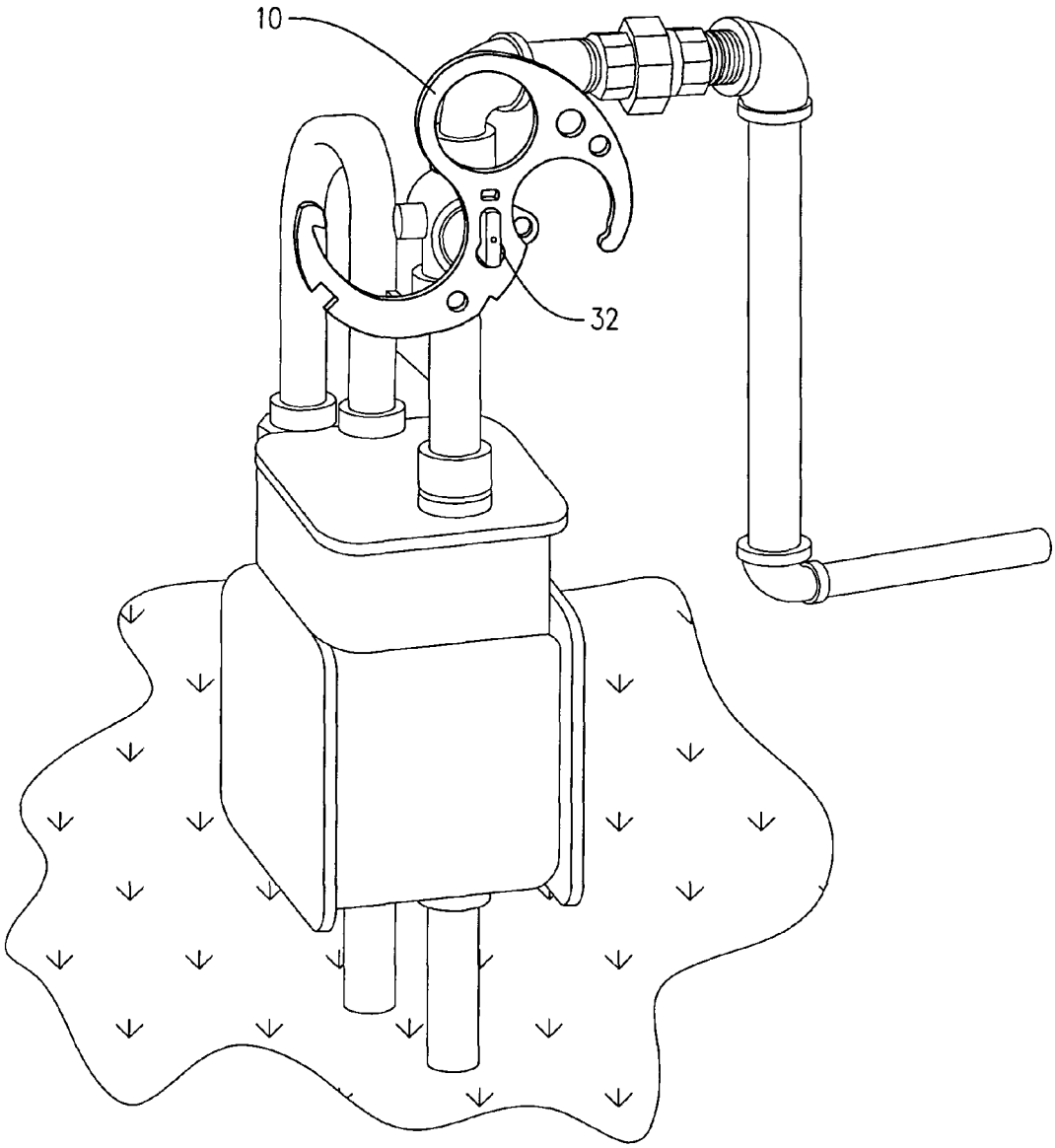
FIG. 3 is a representation of the device when used as a valve wrench on a gas valve.
Figure 4:
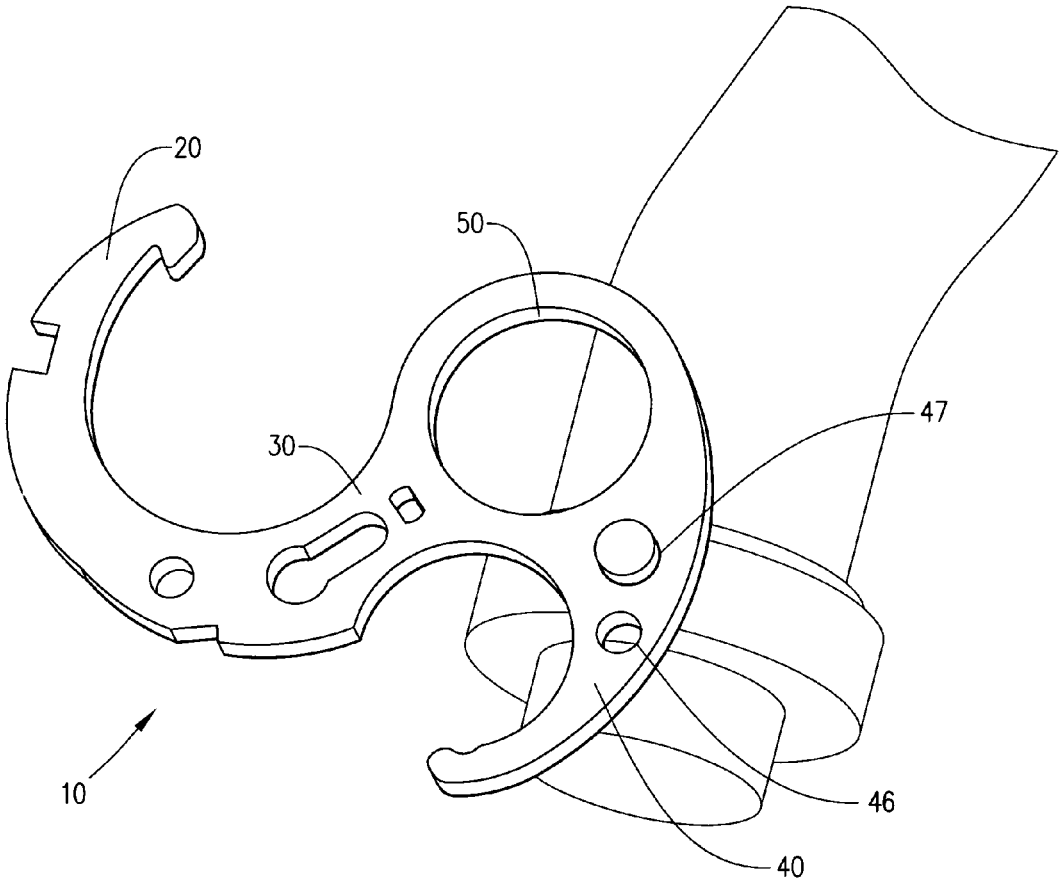
FIG. 4 is a representation of the device when used to remove a pipe cover by attaching the device to a lug on the pipe cover.
Figure 5:
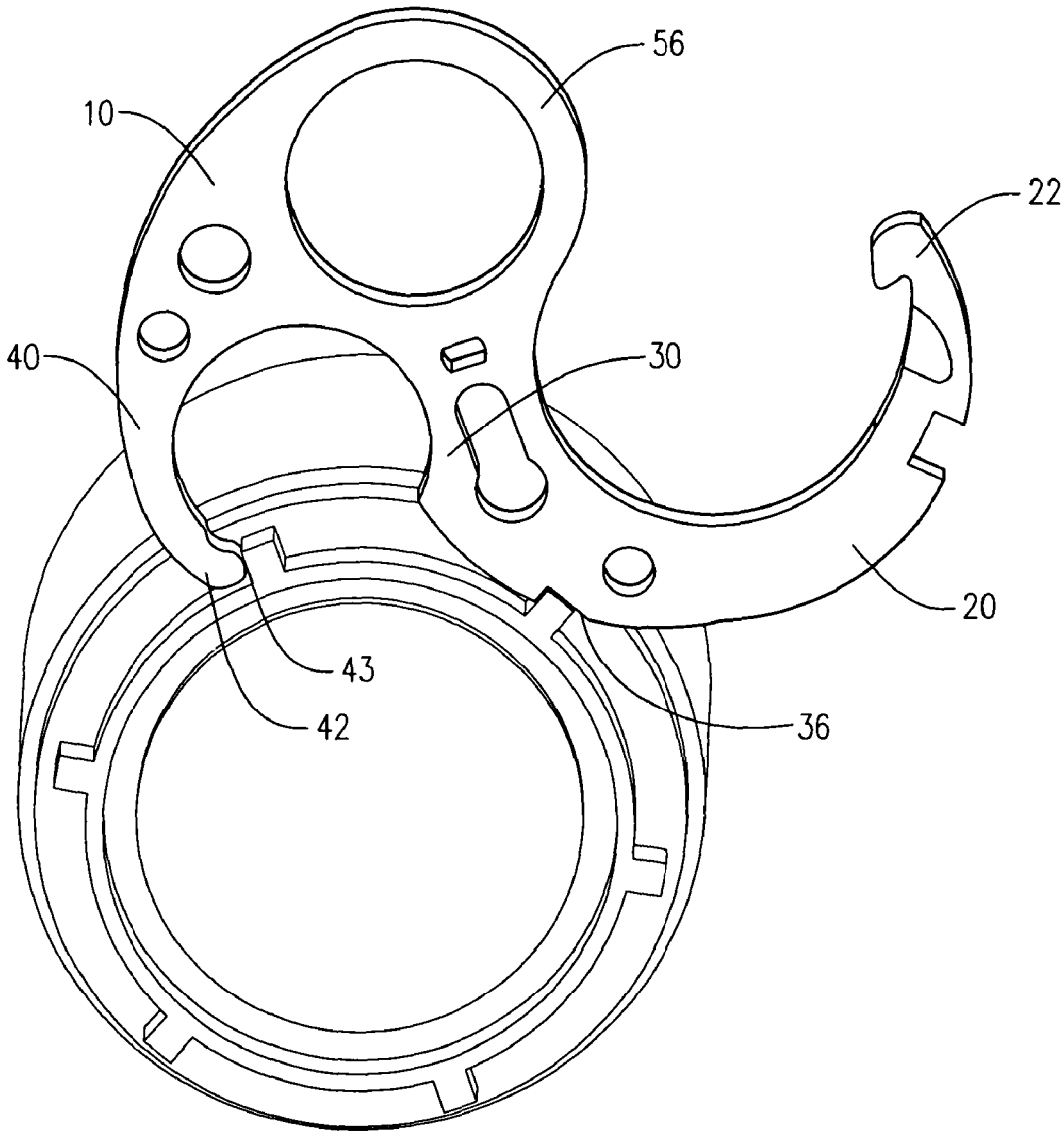
FIG. 5 is a representation of the device being used to remove a STORZ coupling similar to a spanner tool.
Figure 5:
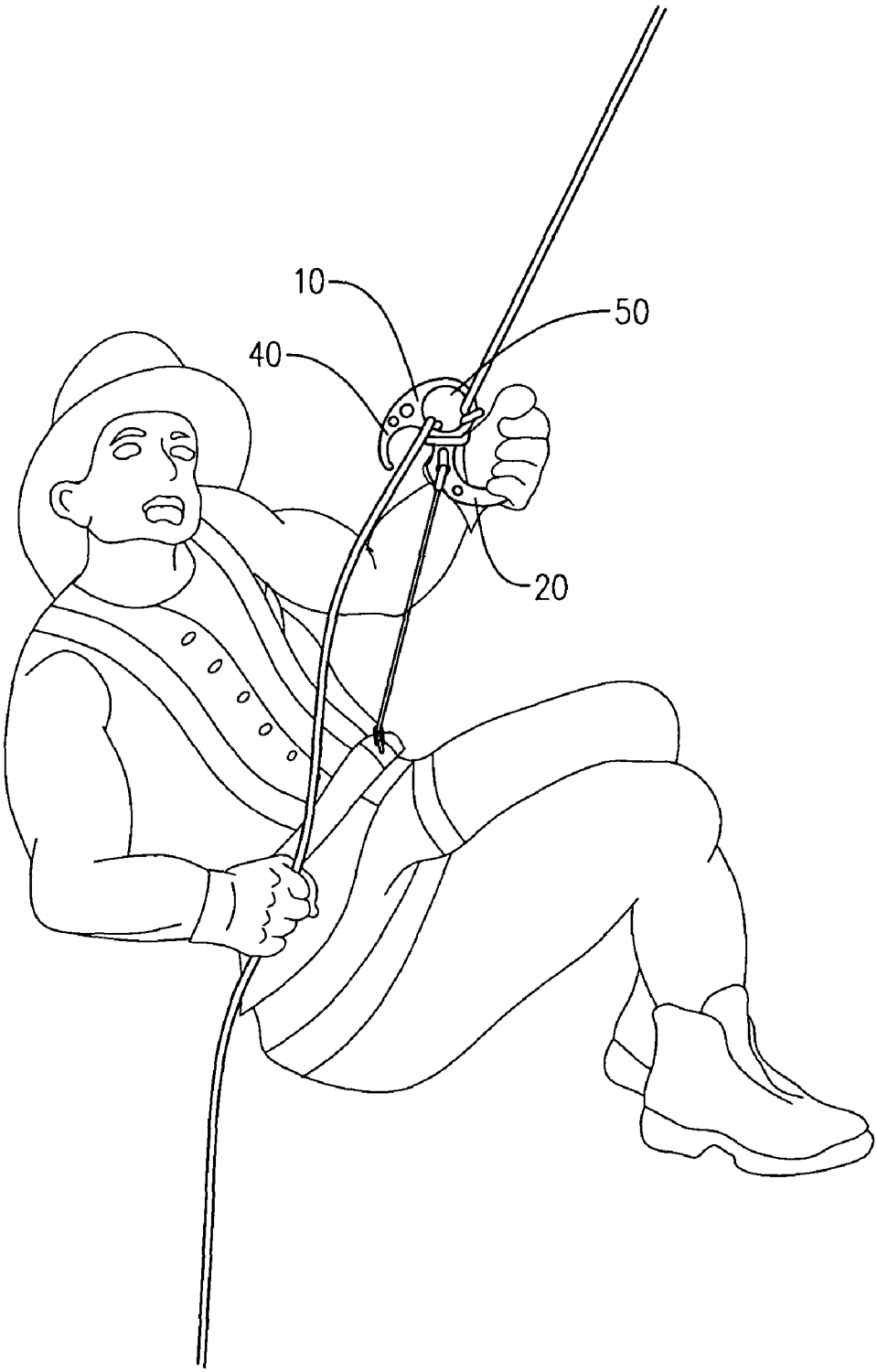
Figure 7:
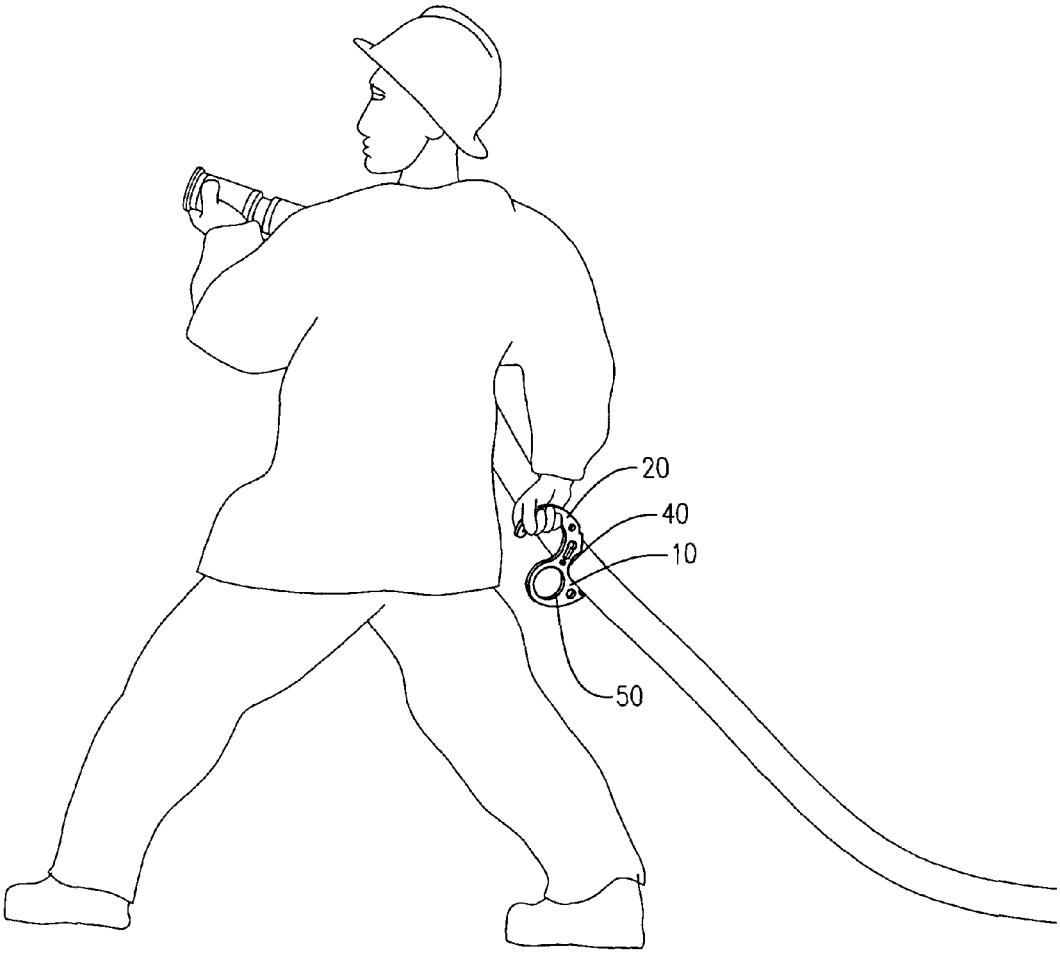
FIG. 7 is a representation of the device secured to a fire hose as a means to control the fire hose when extinguishing a fire.

FIG. 2 illustrates the optimal reference angles for the tool to properly serve as a spanner wrench for both the upper loop 40 and the lower loop 20. A base reference line x is defined as a straight line across an upper margin 48 of the upper loop 40 and an upper margin 52 of the closed circular handle portion 50. A first angle α, properly positioning the inner tip 22 of the lower loop 20 is defined and formed by a first angle line y between a point θ along the base reference line x intersecting the upper margin 52 of the closed circular handle portion 50, and the inner tip 22 of the lower loop 20 and the base reference line x, the first angle α formed by these two lines at 75-90 degrees, and most preferably 87 degrees. A second angle β is defined by a second angle line z traveling through the inner tip 42 of the upper loop 40 and the inner loop shoulder 44, that line z intersecting the base reference line x forming the second angle β at a 56 degree angle, or an angle between 45 and 60 degrees. The second angle β positions the STORZ connector wrench notch 43 and the corresponding inner loop shoulder 44 of the upper loop 40 for optimal leverage on a STORZ or spanner coupling while the first angle α positions the STORZ connector wrench notch 23 and a contact fulcrum point 56 along a lower side margin 54 of said tool 10 along the closed circular handle portion 50, FIG. 2 and as indicated on FIG. 5, when the lower loop 20 is used to tighten or loosen a spanner or STORZ coupling. If these respective angles are not maintained, the upper and lower loops may not be able to maintain secure contact with the couplings when great leverage forces are applied to the tool when used to open or close a coupling.

Because of the leverage forces and bending forces applied to the tool 10 during its use for various functions, the tool 10 should be completely non-deformable when both straight and rotational forces are applied. In this regard, it would be preferred that the tool 10 be made of a single sheet of hard metal, cast of metal, extremely hard plastics or composite materials, but also be light enough that it can be carried on a belt by a firefighter during firefighting activities.

While the invention has been particularly shown and described with reference to a preferred embodiment thereof, it will be understood by those skilled in the art that changes in form and detail may be made therein without departing from the spirit and scope of the invention.

What is claimed is:

1. A compact S-shaped multiple use tool for use by firefighters made from a shingle sheet or a single cast of a strong, non-deformable material, said tool comprising:

a lower loop providing an inner tip with a drag hook and having a inner diameter to hook and retain a large fire hose;

a central transition portion defining a STORZ notch; and an upper loop defining an inner tip with a spanner indent and an inner loop shoulder, a closed circular handle portion, and providing an inner diameter to hook and retain a small fire hose, said tool providing use as a hose connector wrench, a large and small hose carrier and hanger, a rappel anchor, a hose connector wrench, a spanner wrench, a valve wrench, a prying device, a hook anchor device or a tool hanger.

2. The tool as disclosed in claim 1, further comprising:

a first angle formed by a base reference line defined as a straight line across an upper margin of said upper loop and an upper margin of said closed circular handle portion and a first angle line between an intersecting point of said reference line and said upper margin of said closed circular handle point and said inner tip, said first angle between 75-90 degrees; and a second angle formed by said base reference line and a second angle line between said inner tip of said upper loop and said upper loop shoulder, said second angle between 45 and 60 degrees, wherein said second angle places said STORZ notch and said spanner indent in a position for optimum secure leverage on a STORZ or spanner coupling while said first angle positions said inner tip and contact fulcrum point along a lower side margin of said tool along said closed circular handle portion when said lower loop is used to tighten or loosen a spanner or STORZ coupling.

3. The tool as disclosed in claim 1, wherein said lower loop further comprises:

a tapered cutting notch on an inner margin of said lower loop adjacent to said the drag hook for use to rip glass and screen material in an automobile, structure or building to gain entry.

4. A compact S-shaped multiple use tool for use by firefighters made from a shingle sheet or a single cast of a strong, non-deformable material, said tool comprising:

a lower loop providing an inner tip with a drag hook, a large water or gas valve notch and having a inner diameter to hook and retain a large fire hose, with a side portion defining at least one small pin or lug spanner bore;

a central transition portion defining a gas valve slot, an oxygen bottle valve opening and a STORZ notch; and an upper loop defining an inner tip with a spanner indent and an inner loop shoulder, and closed circular handle portion, at least one small pin lug opening and a large pin lug opening, and having an inner diameter to hook and retain a small fire hose, said tool providing use as a hose connector wrench, a large and small hose carrier and hanger, a rappel anchor, a hose connector wrench, a spanner wrench, a valve wrench, and pry device, a hook anchor device or a tool hanger.

5. The tool as disclosed in claim 4, further comprising:

a first angle formed by a base reference line defined as a straight line across an upper margin of said upper loop and an upper margin of said closed circular handle portion and a first angle line between an intersecting point of said reference line and said upper margin of said closed circular handle point and said inner tip, said first angle between 75-90 degrees; and a second angle formed by said base reference line and a second angle line between said inner tip of said upper loop and said upper loop shoulder, said second angle between 45 and 60 degrees, wherein said second angle places said STORZ notch and said spanner indent in a position for optimum secure leverage on a STORZ or spanner coupling while said first angle positions said inner tip and contact fulcrum point along a lower side margin of said tool along said closed circular handle portion when said lower loop is used to tighten or loosen a spanner or STORZ coupling.

6. The tool as disclosed in claim 4, wherein said lower loop further comprises:

a tapered cutting notch on an inner margin of said lower loop adjacent to said drag hook for use to rip glass and screen material in an automobile, structure or building to gain entry.

* * * * *